US008820252B2

(12) United States Patent
Takahata et al.

(10) Patent No.: US 8,820,252 B2
(45) Date of Patent: Sep. 2, 2014

(54) EMBROIDERY DATA PROCESSING DEVICE, COMPUTER-READABLE STORAGE MEDIUM STORING EMBROIDERY DATA PROCESSING PROGRAM, AND SEWING MACHINE

(75) Inventors: Hirotsugu Takahata, Nagoya (JP); Harumi Kato, Nagoya (JP); Noriharu Tashiro, Nagoya (JP); Tsuneo Okuyama, Inabe-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 995 days.

(21) Appl. No.: 12/902,809

(22) Filed: Oct. 12, 2010

(65) Prior Publication Data

US 2011/0088604 A1 Apr. 21, 2011

(30) Foreign Application Priority Data

Oct. 19, 2009 (JP) ..... 2009-240060

(51) Int. Cl.
*D05B 21/00* (2006.01)
*D05B 19/10* (2006.01)
*D05C 5/04* (2006.01)

(52) U.S. Cl.
CPC ..... *D05B 19/10* (2013.01); *D05D 2205/12* (2013.01); *D05C 5/04* (2013.01)
USPC ..... 112/102.5

(58) Field of Classification Search
USPC ..... 112/102.5, 470.01, 470.03, 470.04, 112/470.06, 470.09, 470.14, 470.18, 475.19
See application file for complete search history.

(56) References Cited

U.S. PATENT DOCUMENTS

| | | | | | |
|---|---|---|---|---|---|
| 4,823,714 | A | * | 4/1989 | Yokoe et al. | 112/475.05 |
| 5,228,403 | A | * | 7/1993 | Sugimoto | 112/470.06 |
| 5,255,620 | A | * | 10/1993 | Sasano et al. | 112/102.5 |
| 5,390,615 | A | | 2/1995 | Sugimoto | |
| 5,671,410 | A | * | 9/1997 | Mizuno et al. | 1/1 |
| 5,855,176 | A | * | 1/1999 | Takenoya et al. | 112/102.5 |
| 6,600,966 | B1 | * | 7/2003 | Bailie | 700/138 |

FOREIGN PATENT DOCUMENTS

| | | |
|---|---|---|
| JP | Y2-05-38705 | 9/1993 |
| JP | A-06-233883 | 8/1994 |
| JP | A-09-176952 | 7/1997 |

* cited by examiner

*Primary Examiner* — Tejash Patel
(74) *Attorney, Agent, or Firm* — Oliff PLC

(57) ABSTRACT

A embroidery data processing device includes an area defining portion that defines a sewable area on the work cloth, a computation portion that computes a first characteristic quantity that specifies a size of the sewable area, a comparison portion that compares the first characteristic quantity to at least one characteristic quantity for at least one embroidery pattern that can be sewn based on the embroidery data, the at least one characteristic quantity being stored in a storage portion and specifying a size of the at least one embroidery pattern, an extraction portion that, in a case where a comparison indicates that at least one sewable pattern exists, extracts the at least one sewable pattern, the at least one sewable pattern being at least one embroidery pattern that fits within the sewable area, a notification portion that notifies a user about the at least one sewable pattern.

20 Claims, 15 Drawing Sheets

FIG. 3

71

| EMBROIDERY PATTERN DATA TABLE | | | | | | | |
|---|---|---|---|---|---|---|---|
| CONTROL ID | FILE NAME | WIDTH (cm) | HEIGHT (cm) | THREAD COLOR LIST | CLASSIFICATION | IMAGE DATA | EMBROIDERY DATA |
| 1 | 33102706 B. PES | 9.6 | 5.2 | WHITE, SILVER, MANDARIN, BLACK | VEHICLE | ・・・ | ・・・ |
| 2 | 33102706 M. PES | 6.0 | 3.3 | WHITE, SILVER, MANDARIN, BLACK | VEHICLE | ・・・ | ・・・ |
| 3 | 33102706 S. PES | 2.0 | 1.1 | WHITE, SILVER, MANDARIN, BLACK | VEHICLE | ・・・ | ・・・ |
| 4 | 33102709 B. PES | 3.8 | 9.2 | SILVER, BROWN, BLACK, WHITE, BLUE, BLACK, RED | VEHICLE | ・・・ | ・・・ |
| 5 | 33102709 M. PES | 2.4 | 6.0 | SILVER, BROWN, BLACK, WHITE, BLUE, BLACK, RED | VEHICLE | ・・・ | ・・・ |
| 6 | 33102709 S. PES | 0.8 | 2.0 | SILVER, BROWN, BLACK, WHITE, BLUE, BLACK, RED | VEHICLE | ・・・ | ・・・ |
| 7 | 33102704 B. PES | 9.0 | 7.0 | DARK BROWN, RED, SILVER, WHITE, BLACK | VEHICLE | ・・・ | ・・・ |
| 8 | 33102704 M. PES | 6.0 | 4.7 | DARK BROWN, RED, SILVER, WHITE, BLACK | VEHICLE | ・・・ | ・・・ |
| 9 | 33102704 S. PES | 2.0 | 1.6 | DARK BROWN, RED, SILVER, WHITE, BLACK | VEHICLE | ・・・ | ・・・ |
| 10 | 23102508 B. PES | 9.8 | 7.8 | SILVER, GRAY, DARK GRAY, BLACK | ANIMAL | ・・・ | ・・・ |
| 11 | 23102508 M. PES | 6.0 | 4.8 | SILVER, GRAY, DARK GRAY, BLACK | ANIMAL | ・・・ | ・・・ |
| 12 | 23102508 S. PES | 2.0 | 1.6 | SILVER, GRAY, DARK GRAY, BLACK | ANIMAL | ・・・ | ・・・ |
| 13 | 23103005 B. PES | 9.5 | 6.4 | OCHER, BROWN, LIGHT BROWN, DARK BROWN, BEIGE, BLACK | ANIMAL | ・・・ | ・・・ |
| 14 | 23103005 M. PES | 6.0 | 4.0 | OCHER, BROWN, LIGHT BROWN, DARK BROWN, BEIGE, BLACK | ANIMAL | ・・・ | ・・・ |
| 15 | 23103005 S. PES | 2.0 | 1.4 | OCHER, BROWN, LIGHT BROWN, DARK BROWN, BEIGE, BLACK | ANIMAL | ・・・ | ・・・ |
| 16 | 23103011 B. PES | 8.5 | 7.0 | BROWN, LETTUCE GREEN, YELLOW GREEN, MOSS GREEN, OCHER, BROWN, SILVER, GRAY, DARK BROWN | ANIMAL | ・・・ | ・・・ |
| 17 | 23103021 M. PES | 6.0 | 4.7 | WHITE, GRAY, DARK GRAY, CREAM, BLACK | ANIMAL | ・・・ | ・・・ |
| 18 | 23103022 M. PES | 3.4 | 6.0 | CREAM, SILVER, GRAY, DARK GRAY, BLACK | ANIMAL | ・・・ | ・・・ |
| 19 | 23103016 S. PES | 2.0 | 1.4 | WHITE, GRAY, BEIGE, GOLDEN BROWN, BROWN, DARK BROWN, BLACK | ANIMAL | ・・・ | ・・・ |
| 20 | 23103024 S. PES | 2.0 | 0.8 | LETTUCE GREEN, YELLOW GREEN, MOSS GREEN, GREEN, BLACK, GRAY, BLUE GREEN | ANIMAL | ・・・ | ・・・ |

FIG. 13

| | | | | |
|---|---|---|---|---|
| 6.0×4.8 | 6.0×4.7 | 6.0×4.7 | 6.0×4.0 | 3.4×6.0 |
| 6.0×3.3 | 2.4×6.0 | 2.0×1.6 | 2.0×1.6 | 2.0×1.6 |
| 2.0×1.4 | 2.0×1.0 | 0.8×2.0 | 2.0×0.8 | |
| | | | | |

FIG. 14
| | | | | |
|---|---|---|---|---|
| 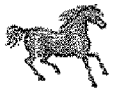 6.0×4.8 | 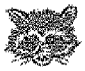 6.0×4.7 | 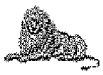 6.0×4.0 | 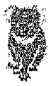 3.4×6.0 | |
| | | | | |
| | | | | |
| | | | | |

EMBROIDERY DATA PROCESSING DEVICE, COMPUTER-READABLE STORAGE MEDIUM STORING EMBROIDERY DATA PROCESSING PROGRAM, AND SEWING MACHINE

This application claims priority to Japanese Patent Application No. 2009-240060, filed Oct. 19, 2009, the content of which is hereby incorporated herein by reference in its entirety.

BACKGROUND

The present disclosure relates to an embroidery data processing device, a computer-readable storage medium that stores an embroidery data processing program, and a sewing machine, the embroidery data processing program being capable of creating embroidery data for sewing a user's desired embroidery pattern.

A technology is known that causes a sewing machine to sew a user's desired embroidery pattern. In a case where the sewing machine is made to sew the embroidery pattern, the user's desired embroidery pattern must fit into a sewing area where the embroidery pattern is sewn. For example, an embroidery sewing machine exists that detects the sewing area by optically detecting a marker that is affixed to a work cloth. The embroidery sewing machine enlarges, reduces, or changes the shape of an embroidery pattern that has been selected by a user, such that the embroidery pattern conforms to the detected sewing area.

SUMMARY

When the embroidery pattern has been processed such that it conforms to the detected sewing area and the sewing is performed, the embroidery pattern that is sewn may become a different embroidery pattern from what the user desired. Accordingly, it may be desirable for the sewing to be performed without the embroidery pattern having been processed. However, it may be cumbersome and difficult for the user to determine personally whether the embroidery pattern conforms to the detected sewing area.

Various exemplary embodiments of the general principles herein provide an embroidery data processing device, a computer-readable storage medium that stores an embroidery data processing program, and a sewing machine that can extract an embroidery pattern that is suitable for the sewing area and present the embroidery pattern to the user.

Exemplary embodiments provide an embroidery data processing device that processes embroidery data for sewing an embroidery pattern on a work cloth in a sewing machine that is capable of performing embroidery sewing. The embroidery data processing device includes an area defining portion, a computation portion, a comparison portion, an extraction portion, and a notification portion. The area defining portion defines a sewable area that is an area on the work cloth where the embroidery pattern can be sewn. The computation portion computes a first characteristic quantity that is a quantity that specifies a size of the sewable area defined by the area defining portion. The comparison portion compares the first characteristic quantity computed by the computation portion to at least one characteristic quantity for at least one embroidery pattern that can be sewn based on the embroidery data, the at least one characteristic quantity being stored in a storage portion that stores data and specifying a size of the at least one embroidery pattern. The extraction portion, in a case where a comparison by the comparison portion indicates that at least one sewable pattern exists, extracts the at least one sewable pattern, the at least one sewable pattern being at least one embroidery pattern that fits within the sewable area. The notification portion notifies a user about the at least one sewable pattern extracted by the extraction portion.

Exemplary embodiments further provide a computer-readable medium storing an embroidery data processing program for processing embroidery data for sewing an embroidery pattern on a work cloth in a sewing machine that is capable of performing embroidery sewing. The embroidery data processing program includes instructions that cause a computer to perform the steps of defining a sewable area that is an area on the work cloth where the embroidery pattern can be sewn, computing a first characteristic quantity that is a quantity that specifies a size of the sewable area that has been defined, comparing the first characteristic quantity that has been computed to at least one characteristic quantity for at least one embroidery pattern that can be sewn based on the embroidery data, the at least one characteristic quantity being stored in a storage portion that stores data and specifying a size of the at least one embroidery pattern, extracting at least one sewable pattern that is at least one embroidery pattern that fits within the sewable area, in a case where a comparison indicates that the at least one sewable pattern exists, and notifying a user about the at least one sewable pattern that has been extracted.

Exemplary embodiments further provide a sewing machine that is capable of processing embroidery data for sewing an embroidery pattern on a work cloth and performing embroidery sewing. The sewing machine includes an area defining portion, a computation portion, a comparison portion, an extraction portion, a notification portion, an image capture portion, a pattern setting portion, and a sewing portion. The area defining portion defines a sewable area that is an area on the work cloth where the embroidery pattern can be sewn. The computation portion computes a first characteristic quantity that is a quantity that specifies a size of the sewable area defined by the area defining portion. The comparison portion compares the first characteristic quantity computed by the computation portion to at least one characteristic quantity for at least one embroidery pattern that can be sewn based on the embroidery data, the at least one characteristic quantity being stored in a storage portion that stores data and specifying a size of the at least one embroidery pattern. The extraction portion, in a case where a comparison by the comparison portion indicates that at least one sewable pattern exists, extracts the at least one sewable pattern, the at least one sewable pattern being at least one embroidery pattern that fits within the sewable area. The notification portion notifies a user about the at least one sewable pattern extracted by the extraction portion. The image capture portion captures an image of the work cloth. The pattern setting portion takes one of the at least one sewable pattern about which the notification portion has notified the user, and that the user has selected, and sets the selected sewable pattern as the embroidery pattern that will be sewn on the work cloth. The sewing portion that sews, within the sewable area on the work cloth of which the image has been captured by the image capture portion, the embroidery pattern set by the pattern setting portion.

BRIEF DESCRIPTION OF THE DRAWINGS

Exemplary embodiments will be described below in detail with reference to the accompanying drawings in which:

FIG. 3 is an explanatory figure of a data table that is stored in a data table storage area of a memory card;

FIG. 13 is a figure that shows an example of the embroidery patterns that are displayed on the liquid crystal display in a case where only the sewable area R1 has been defined;

FIG. 14 is a figure that shows an example of the embroidery patterns that are displayed on the liquid crystal display in a case where a minimum sewing area R2 has been defined in addition to the sewable area R1 that is shown in FIG. 13.

DETAILED DESCRIPTION

Figure 1:
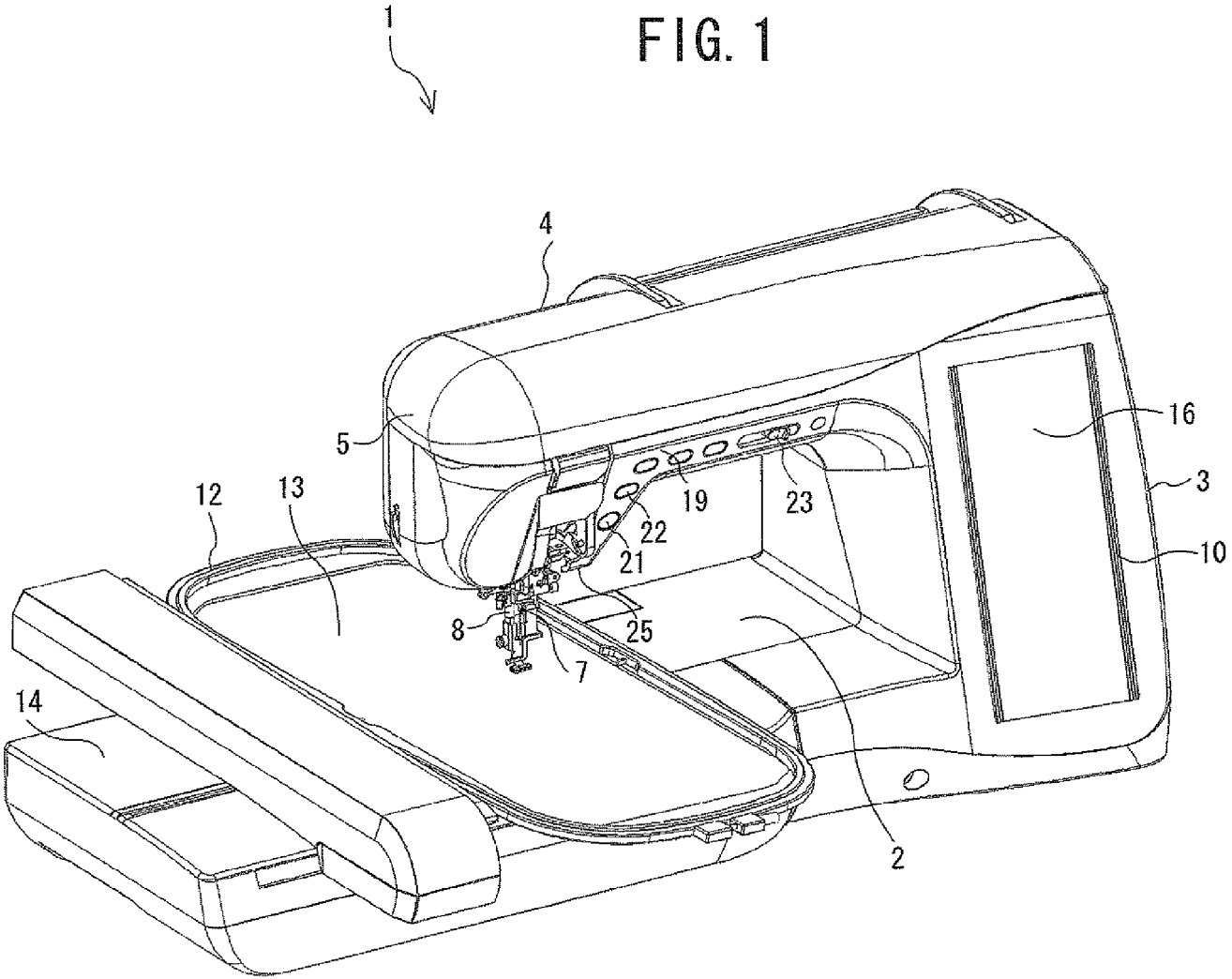
FIG. 1 is an oblique view of an entire sewing machine.

Hereinafter, an embodiment according to the present disclosure will be explained with reference to the drawings. Note that the referenced drawings are used to explain technological features that can be used in the present disclosure. Device configurations, flowcharts of various types of processing, and the like that are shown in the drawings are merely explanatory examples and do not have the effect of limiting the present disclosure only to those examples.

A physical configuration of a sewing machine 1 will be explained with reference to FIG. 1. In FIG. 1, the upper right side of the page corresponds to the right side of the sewing machine 1. In FIG. 1, the lower left side of the page corresponds to the left side of the sewing machine 1. In FIG. 1, the upper left side of the page corresponds to the rear side of the sewing machine 1. In FIG. 1, the lower right side of the page corresponds to the front side (the front face side) of the sewing machine 1. The sewing machine 1 includes a bed 2, a pillar 3, and an arm 4, and a head 5. The bed 2 extends in the left-right direction and supports the sewing machine 1. The pillar 3 is provided such that it rises upward from the right end of the bed 2. The arm 4 extends to the left from the upper end of the pillar 3, such that it is opposite the bed 2. The head 5 is provided on the left end portion of the arm 4. The head 5 is provided with a needle bar 7, a presser bar 8, and the like. A sewing machine motor 79 (refer to FIG. 2), a drive shaft (not shown in the drawings), and a needle bar up-and-down unit (not shown in the drawings) are provided in the interior of the sewing machine 1.

An embroidery frame moving unit 14 is attached to the bed 2. An embroidery frame 12 is attached to the embroidery frame moving unit 14. The embroidery frame 12 holds a work cloth 13 and is moved by the embroidery frame moving unit 14 in an X axis direction (the left-right direction of the sewing machine 1) and a Y axis direction (the front-rear direction of the sewing machine 1). The sewing machine 1 performs sewing of an embroidery pattern by operating the needle bar 7 and the like while the work cloth 13 that is held by the embroidery frame 12 is moved by the embroidery frame moving unit 14. The operations of the embroidery frame moving unit 14, the needle bar 7 and the like are controlled by a CPU 61 (refer to FIG. 2) of the sewing machine 1, based on embroidery data.

The pillar 3 is provided with a liquid crystal display 10 on its front face. The liquid crystal display 10 is provided with a touch panel 16 on its surface. The liquid crystal display 10 is a display that is capable of displaying in color, and it displays an embroidery pattern, an input key, and the like. A user inputs one of a desired embroidery pattern and an operating command to the sewing machine 1 by touching a portion of the touch panel 16 that corresponds to the position where the one of the embroidery pattern and the input key is respectively displayed on the liquid crystal display 10. An image that is captured by an image sensor 50 that will be described later is displayed on the liquid crystal display 10. By operating the touch panel 16 using one of a finger and a touch pen (not shown in the drawings), the user can designate an area where the embroidery pattern will be sewn. A card slot 17 (refer to FIG. 2) into which a memory card 70 (refer to FIG. 2) is inserted is provided on the right side face of the pillar 3.

The arm 4, in its interior, houses a thread spool (not shown in the drawings) and the like that are used in sewing. A front face cover 19 is provided on the front faces of the arm 4 and the head 5. A plurality of operation switches, such as a sewing start-and-stop switch 21, a reverse stitch switch 22, and the like, are provided on the front face cover 19. The sewing start-and-stop switch 21 is a switch for accepting commands to start and stop the sewing. The reverse stitch switch 22 is a switch for using a feed dog (not shown in the drawings) to feed the work cloth 13 from the rear toward the front, which is the opposite of the normal feed direction. A speed controller 23 that adjusts the sewing speed (the revolution speed of the drive shaft) is provided on the front face cover 19. The image sensor 50 (refer to FIG. 2) is disposed in the interior of the front face cover 19 at a left end lower edge portion 25.

The image sensor 50 may be, for example, a known CMOS image sensor. The image sensor 50 is mounted such that it faces downward and is capable of capturing an image of an area around a needle drop point through which passes a stitching needle (not shown in the drawings) that is mounted in the needle bar 7. The image sensor 50 may also be one of a CCD camera and another image capture element.

Figure 2:
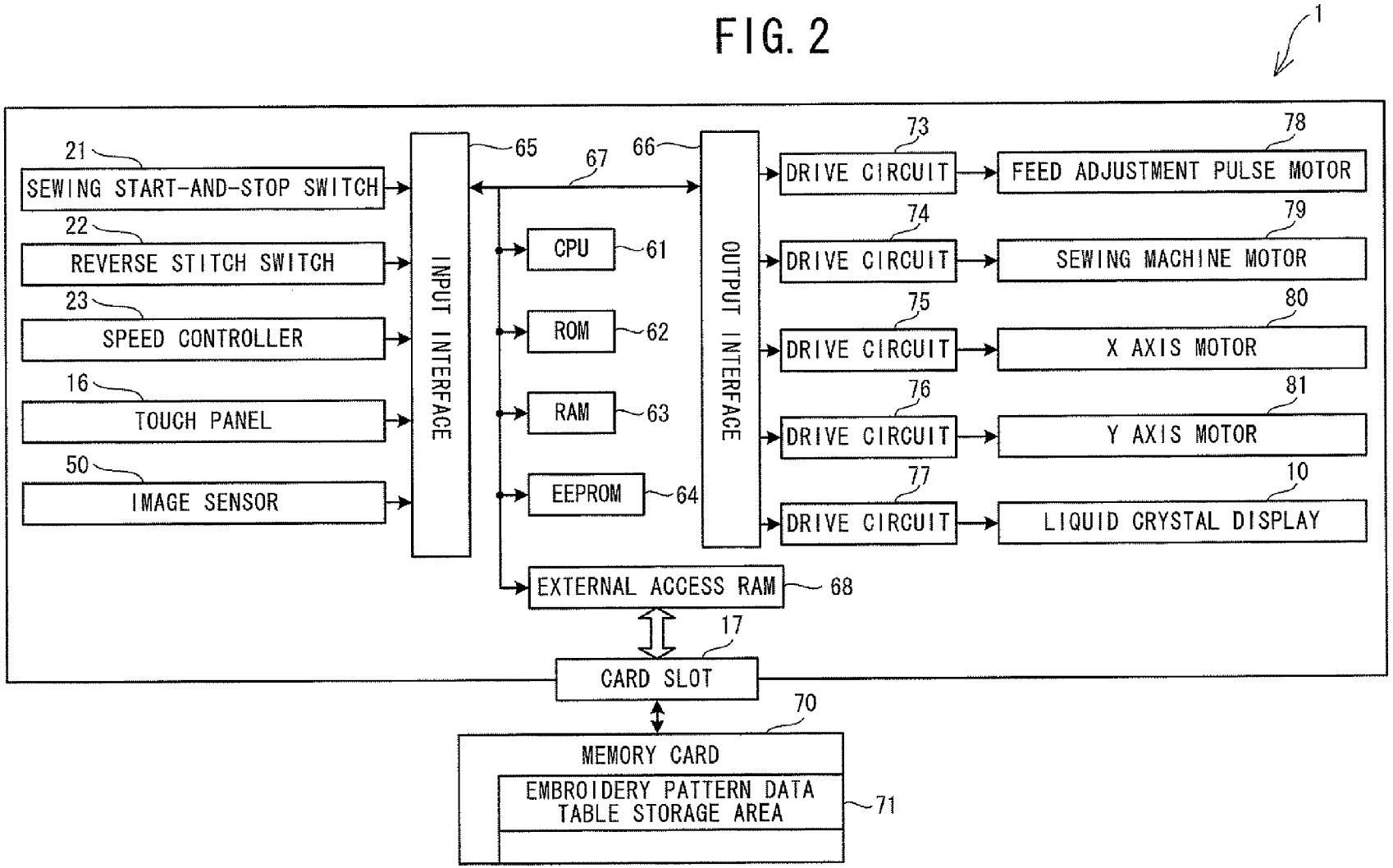
FIG. 2 is a block diagram that shows an electrical configuration of the sewing machine.

The main electrical configuration of the sewing machine 1 will be explained with reference to FIG. 2. The sewing machine 1 includes the CPU 61, a ROM 62, a RAM 63, an EEPROM 64, the card slot 17, an external access RAM 68, an input interface 65, and output interface 66, and the like. These are all connected to one another through a bus 67.

The CPU 61 performs various types of computations and processing in accordance with a control program and performs control of the sewing machine 1. The ROM 62 is a read-only storage element and stores the control program and the like. The RAM 63 is a freely readable and writable storage element. The RAM 63 temporarily stores various types of data, such as data for an image that has been captured by the image sensor 50, a characteristic quantity for an embroidery pattern, which will be described later, and the like. the EEPROM 64 is a non-volatile memory. The EEPROM 64 stores various types of data, including image data for messages, operation keys, and the like that are displayed on the liquid crystal display 10. The external access RAM 68 stores various types of data, such as embroidery data and the like, that are read from the memory card 70 that is connected to the card slot 17. In the present embodiment, the memory card 70 that is connected to the external access RAM 68 is provided with a data table storage area 71. The data table storage area 71 stores a data table that includes various types of data that are related to a plurality of embroidery patterns. The data table will be described later.

The sewing start-and-stop switch 21, the reverse stitch switch 22, the speed controller 23, the touch panel 16, the image sensor 50, and the like are connected to the input interface 65. Drive circuits 73 to 77 are electrically connected to the output interface 66. The drive circuit 73 drives a feed adjustment pulse motor 78. The feed adjustment pulse motor 78 is a motor that adjusts an amount by which the work cloth 13 is fed by the feed dog (not shown in the drawings). The drive circuit 74 drives a sewing machine motor 79. The sewing machine motor 79 rotates the drive shaft. The drive circuit 75 drives an X axis motor 80. The drive circuit 76 drives a Y axis motor 81. The X axis motor 80 and the Y axis motor 81 are built into the embroidery frame moving unit 14. The X axis motor 80 moves the embroidery frame 12 in the X axis direction (the left-right direction). The Y axis motor 81 moves the embroidery frame 12 in the Y axis direction (the front-rear direction). The drive circuit 77 drives the liquid crystal display 10.

The data table that is stored in the memory card 70 will be explained with reference to FIGS. 3 and 4. The data that are contained in the data table include a control ID, a file name, a width, a height, a thread color list, a classification, image data, and embroidery data.

The control ID is an ID that is assigned to the embroidery data for an embroidery pattern in order to control the data that are related to the embroidery pattern. The file name is a name that is assigned to a data file for the embroidery pattern. The width is the width of the smallest rectangle into which the entire embroidery pattern fits, and the height is the height of that smallest rectangle. Therefore, if a rectangular area is larger than the rectangle whose width and height are stored in the data table, the embroidery pattern can be sewn in that area. The thread color list is a list of colors of threads that are to be used in the sewing of the embroidery pattern. The classification indicates a classification to which the embroidery pattern belongs. In the example that is shown in FIG. 3, each of the embroidery patterns belongs to one of the two classifications of "vehicle" and "animal". The image data are data for displaying on the liquid crystal display 10 the embroidery pattern that is to be sewn according to the embroidery data. The embroidery data are the data for the sewing of the embroidery pattern by the sewing machine 1.

The data for the width and the height are used in a case where an embroidery pattern that will fit into a sewable area is extracted, and in a case where extracted embroidery patterns are sorted in the order in which they will be displayed. The data for the thread color list and the classification are used in a case where embroidery patterns are sorted into the order in which they will be displayed, in a case where the embroidery patterns in a designated classification are extracted, and the like.

Figure 4:
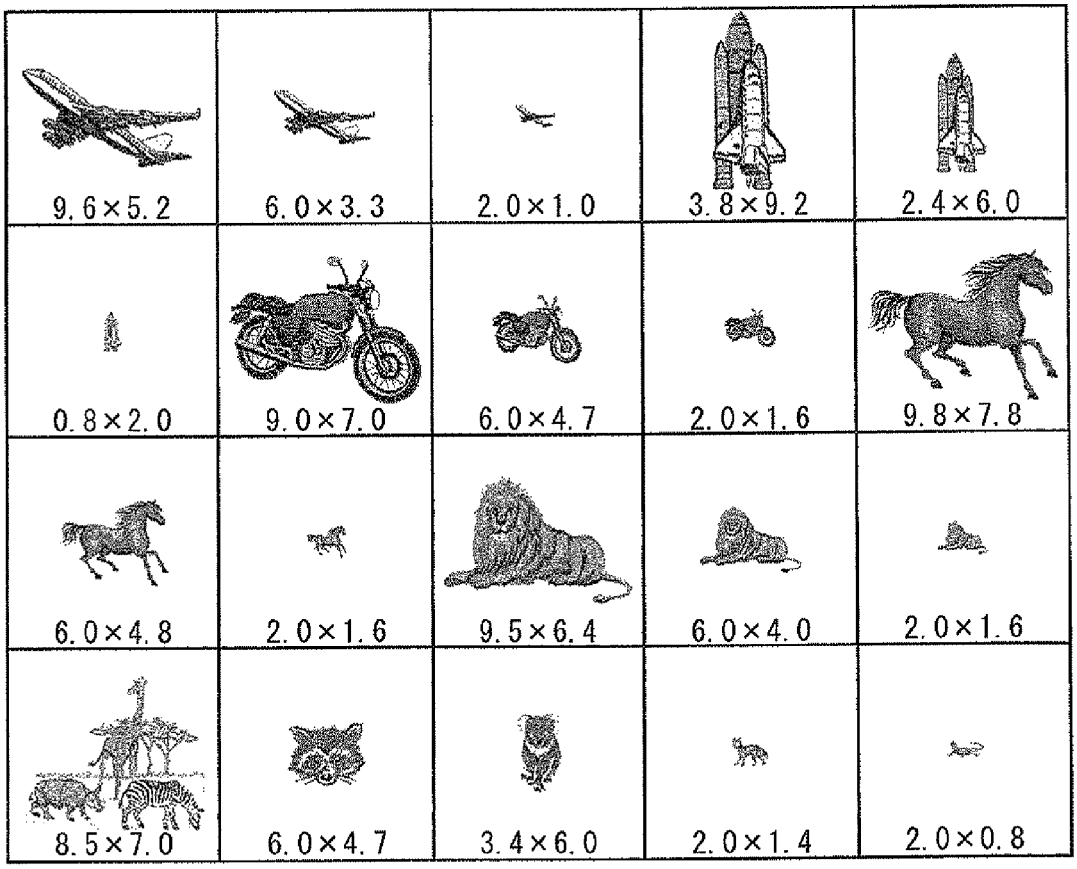
FIG. 4 is a figure that shows an array of embroidery patterns that are displayed on a liquid crystal display before an embroidery pattern that fits into a sewable area is extracted.

FIG. 4 shows a screen that is displayed on the liquid crystal display 10 in a case where the images are displayed for all of the embroidery patterns that are stored in the data table that is shown in FIG. 3. In response to a command from the user, the sewing machine 1 can accordingly display on the liquid crystal display 10 the image data that are stored in the data table. The embroidery patterns that are displayed on the liquid crystal display 10 are displayed in color. The images of the embroidery patterns with the control IDs 1 to 5 are displayed in the top row, starting on the left. In the same manner, the images of the embroidery patterns with the control IDs 6 to 10 are displayed left to right in the second row, those for the control IDs 11 to 15 are displayed in the third row, and those for the control IDs 16 to 20 are displayed in the bottom row. The sewing machine 1 displays the widths and the heights along with the images of the embroidery patterns. The user can thereby perceive the sizes of the embroidery patterns, the colors of the threads to be used, and the classifications of the embroidery patterns (vehicle or animal) by looking at the liquid crystal display 10.

The sewing machine 1 can also extract the embroidery patterns that will fit into the sewable area and can display only the extracted embroidery patterns on the liquid crystal display 10. The user can therefore easily and accurately perceive the embroidery patterns that will fit into the sewable area. The user may select a desired embroidery pattern from among the extracted embroidery patterns. The sewing machine 1 can sew the selected embroidery pattern in an appropriate position on the work cloth 13. This processing will hereinafter be explained in detail.

Figure 5:
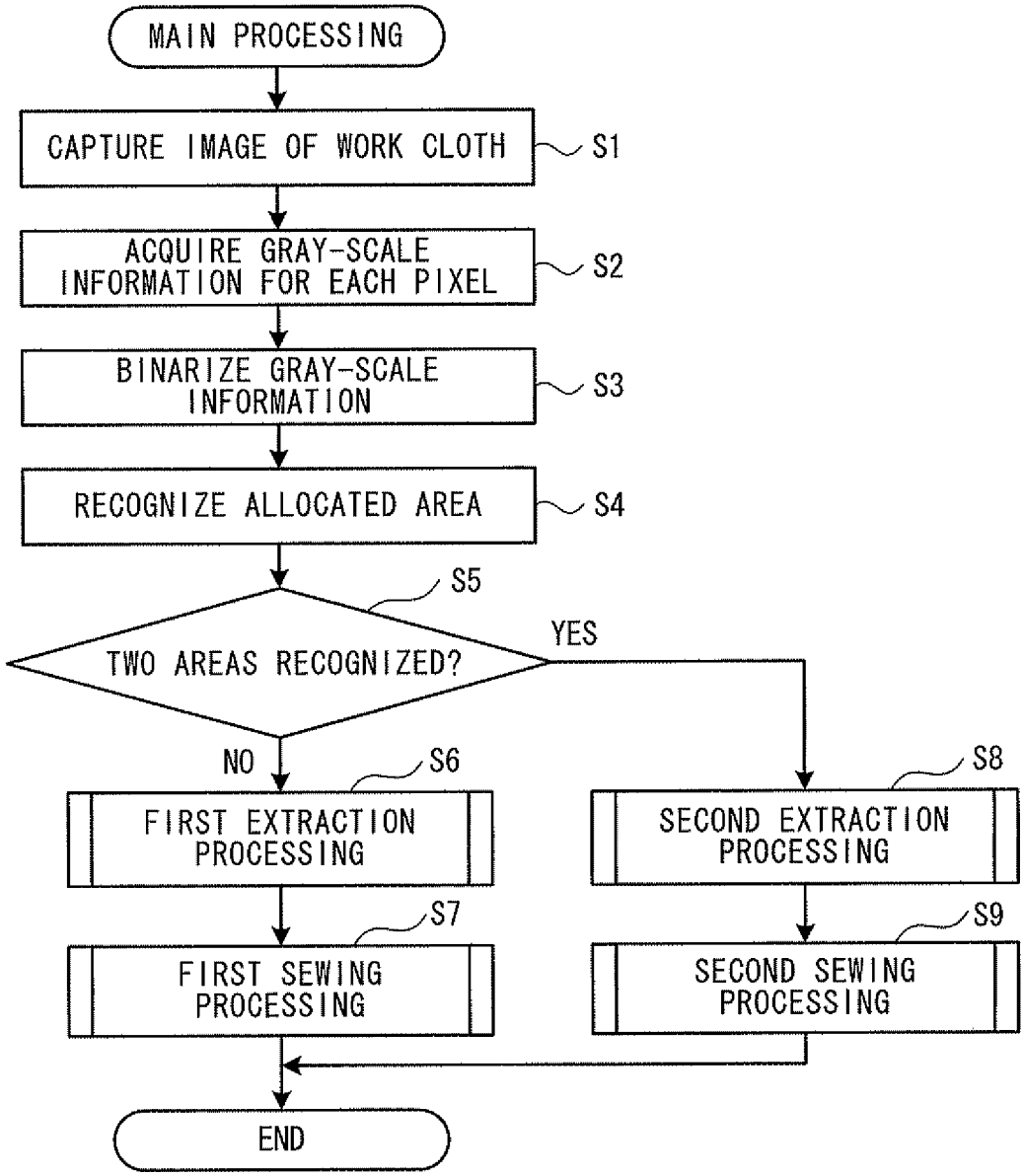
FIG. 5 is a flowchart of main processing that is performed by the sewing machine.

Main processing that the sewing machine 1 performs will be explained with reference to FIGS. 5 to 12. When the user operates the touch panel 16 such that a command is issued to perform processing that extracts an appropriate embroidery pattern, the CPU 61, in accordance with a program that is stored in the ROM 62, performs the main processing that is shown in FIG. 5.

In the present embodiment, the user, before starting the main processing, attaches the work cloth 13 on which the embroidery pattern will be sewn to the embroidery frame 12, then attaches the embroidery frame 12 to the embroidery frame moving unit 14 (refer to FIG. 1). The user allocates a closed area (hereinafter called an allocated area) in a position where the sewing will be performed on the attached work cloth 13. The method for allocating the allocated area may be any method by which the sewing machine 1 can recognize a boundary line of the allocated area based on an image that is captured by the image sensor 50. For example, a method can be used in which the user draws an outline of the allocated area on the work cloth 13, using a chalk pen that is a different color from the color of the work cloth 13. As will be described in detail later, the sewing machine 1 acquires gray-scale information for each pixel in the image that has been captured by the image sensor 50 and recognizes the boundary line of the allocated area based on the gray-scale information. A method other than the method of drawing an outline on the work cloth 13 can also be used. For example, a method may also be used in which a frame member (not shown in the drawings) that is circular, rectangular, or the like is prepared, and the frame member is positioned on the work cloth 13.

In the present embodiment, the user can allocate one allocated area, or two allocated areas on the work cloth 13. In a case where the user has allocated one allocated area, the sewing machine 1 treats the allocated area as the sewable area, which is the area where the embroidery pattern can be sewn. The user can also allocate a separate area within the one allocated area. In that case, the sewing machine 1 treats the larger area as the sewable area. The sewing machine 1 also treats the smaller area within the sewable area as a minimum sewing area. The minimum sewing area is an area that specifies the minimum size of the embroidery pattern that will be sewn.

In the present embodiment, the user can designate in advance a classification of the embroidery patterns that the user wants to sew. If the user designates a classification, the sewing machine 1 is capable of extracting only the embroidery patterns that belong to the designated classification and notifying the user. After going through the procedures that are described above, (the attaching the work cloth 13, the allocating of the allocated area, and, if necessary, the designating of the classification), the user starts the main processing.

As shown in FIG. 5, when the main processing is started, an image of the work cloth 13 is captured by the image sensor 50 (Step S1). Known image processing is performed on the captured image, and the gray-scale information is acquired for each pixel (Step S2). The acquired gray-scale information is binarized (Step S3). The allocated area that the user has allocated on the work cloth 13 is recognized by detecting the outline of the allocated area based on the binarized gray-scale information (Step S4).

A determination is made as to whether two allocated areas have been recognized (Step S5). In a case where one allocated area has been recognized (NO at Step S5), first extraction processing (Step S6) and first sewing processing (Step S7) are performed, and the main processing is terminated. In a case where a separate allocated area is recognized within the already recognized one allocated area, that is, in a case where a total of two allocated areas are recognized (YES at Step S5), second extraction processing (Step S8) and second sewing processing (Step S9) are performed, and the main processing is terminated.

The first extraction processing will be explained with reference to FIG. 6. The first extraction processing is processing that extracts an embroidery pattern in a case where one allocated area has been allocated on the work cloth 13. First, the one recognized allocated area is defined as a sewable area R1 (Step S11). Characteristic quantities for the defined sewable area R1 are computed by characteristic quantity computation processing (Step S12). The characteristic quantities are quantities that specify at least the size of the sewable area R1. In the present embodiment, two quantities, the width and the height, are used as the characteristic quantities. In the characteristic quantity computation processing, the width and the height of the largest rectangle that will fit into the sewable area R1 are computed as the characteristic quantities for the defined sewable area R1.

Figure 7:
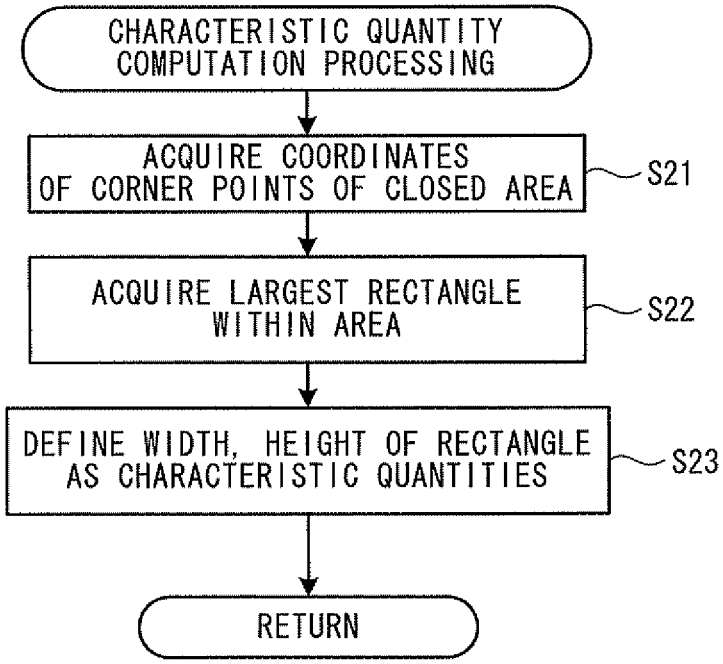
FIG. 7 is a flowchart of characteristic quantity computation processing that is performed during the first extraction processing.
Figure 8:
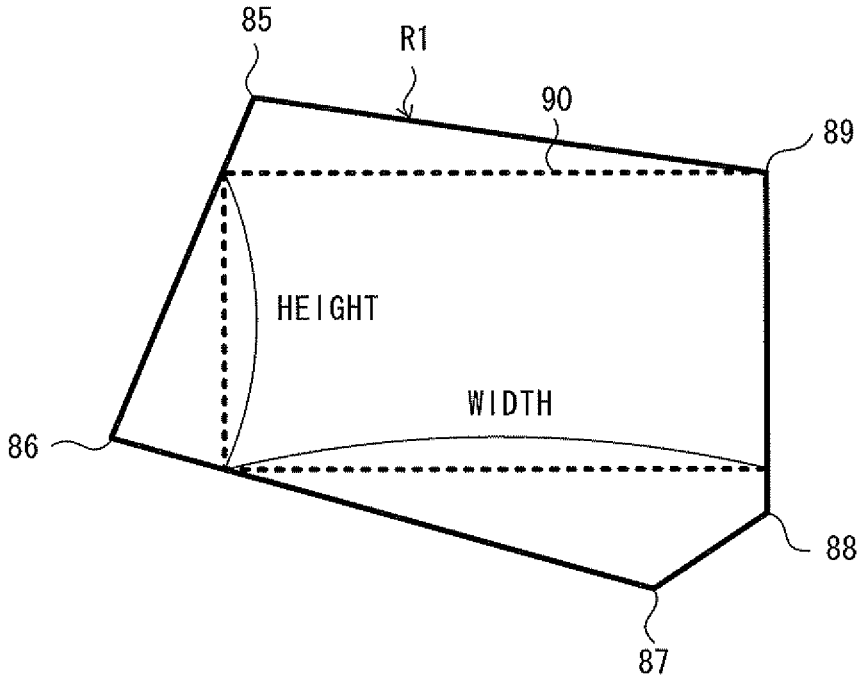
FIG. 8 is a schematic diagram that shows a form of computing a characteristic quantity for a sewable area R1.

As shown in FIGS. 7 and 8, in the characteristic quantity computation processing, the coordinates of corner points (points 85, 86, 87, 88, 89 in FIG. 8) on the boundary line of the sewable area R1, which is a closed area, are acquired (Step S21). This makes it possible to identify the coordinates of the points within the sewable area R1. Next, the maximum rectangle for which the four points that serve as the corners are points within the sewable area R1 (rectangle 90 in FIG. 8) is acquired (Step S22). The width and the height of the acquired rectangle 90 are defined as the characteristic quantities for the sewable area R1 (Step S23). By computing the characteristic quantities according to the processing that is described above, the CPU 61 can easily specify the size of the area in which the embroidery pattern can be sewn, regardless of whether the shape of the defined sewable area R1 is complex. The processing returns to the first extraction processing.

Figure 6:
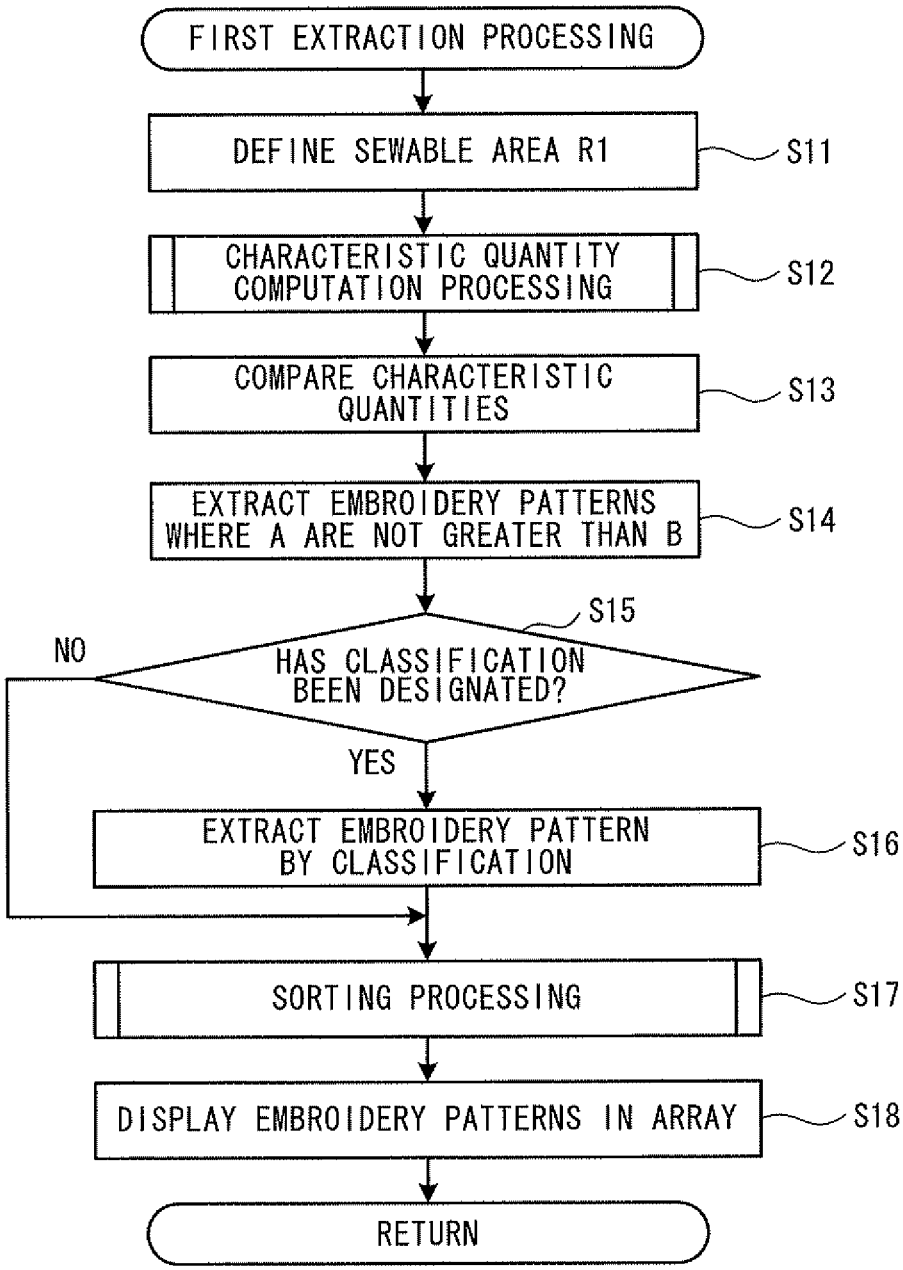
FIG. 6 is a flowchart of first extraction processing that is performed during the main processing.

As shown in FIG. 6, when the characteristic quantity computation processing (Step S12) has been completed, characteristic quantities A for each of the embroidery patterns that are stored in the data table (refer to FIG. 3) are compared to corresponding characteristic quantities B that have been computed for the sewable area R1 (Step S13). The embroidery patterns for which the characteristic quantities A are not greater than the corresponding characteristic quantities B for the sewable area R1 are extracted from the embroidery patterns in the data table (Step S14). In other words, the embroidery patterns for which both the width and the height fit within the sewable area R1 are extracted. More specifically, the embroidery patterns for which the width is not greater than the computed width of the sewable area R1 and the height is not greater than the computed height of the sewable area R1 are extracted.

A determination is made as to whether the user has designated a desired classification for the embroidery pattern (Step S15). As explained previously, the user can designate in advance the classification of the embroidery patterns that the user wants to sew. If the classification has not been designated (NO at Step S15), the processing proceeds to Step S17. If the classification has been designated (YES at Step S15), only the embroidery patterns that belong to the designated classification are extracted from the embroidery patterns that have already been extracted as the embroidery patterns that fit within the sewable area R1 (Step S16). Next, sorting processing is performed that sorts the extracted embroidery patterns into a specified order (Step S17).

Figure 9:
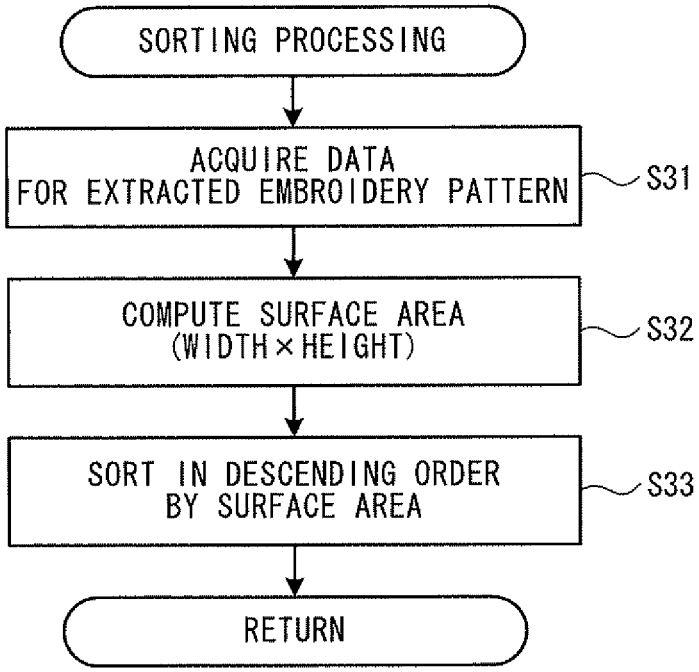
FIG. 9 is a flowchart of sorting processing that is performed during the first extraction processing.

As shown in FIG. 9, when the sorting processing is started, the data for the extracted embroidery patterns are acquired from the data table (refer to FIG. 3) (Step S31). The surface area of the area for each of the extracted embroidery patterns is computed by multiplying the width by the height in the acquired data. In other words, for each of the extracted embroidery patterns, the surface area of the rectangle within which the embroidery pattern fits is computed (Step S32). The data for the embroidery patterns are sorted in descending order by the computed surface area (Step S33). The processing then returns to the first extraction processing. As shown in FIG. 6, when the sorting processing (Step S17) has been completed, the extracted embroidery patterns are displayed in an array on the liquid crystal display 10 in the order in which they have been sorted by the sorting processing (Step S18). The processing then returns to the main processing (refer to FIG. 5), and the first sewing processing is performed (Step S7).

Figure 10:
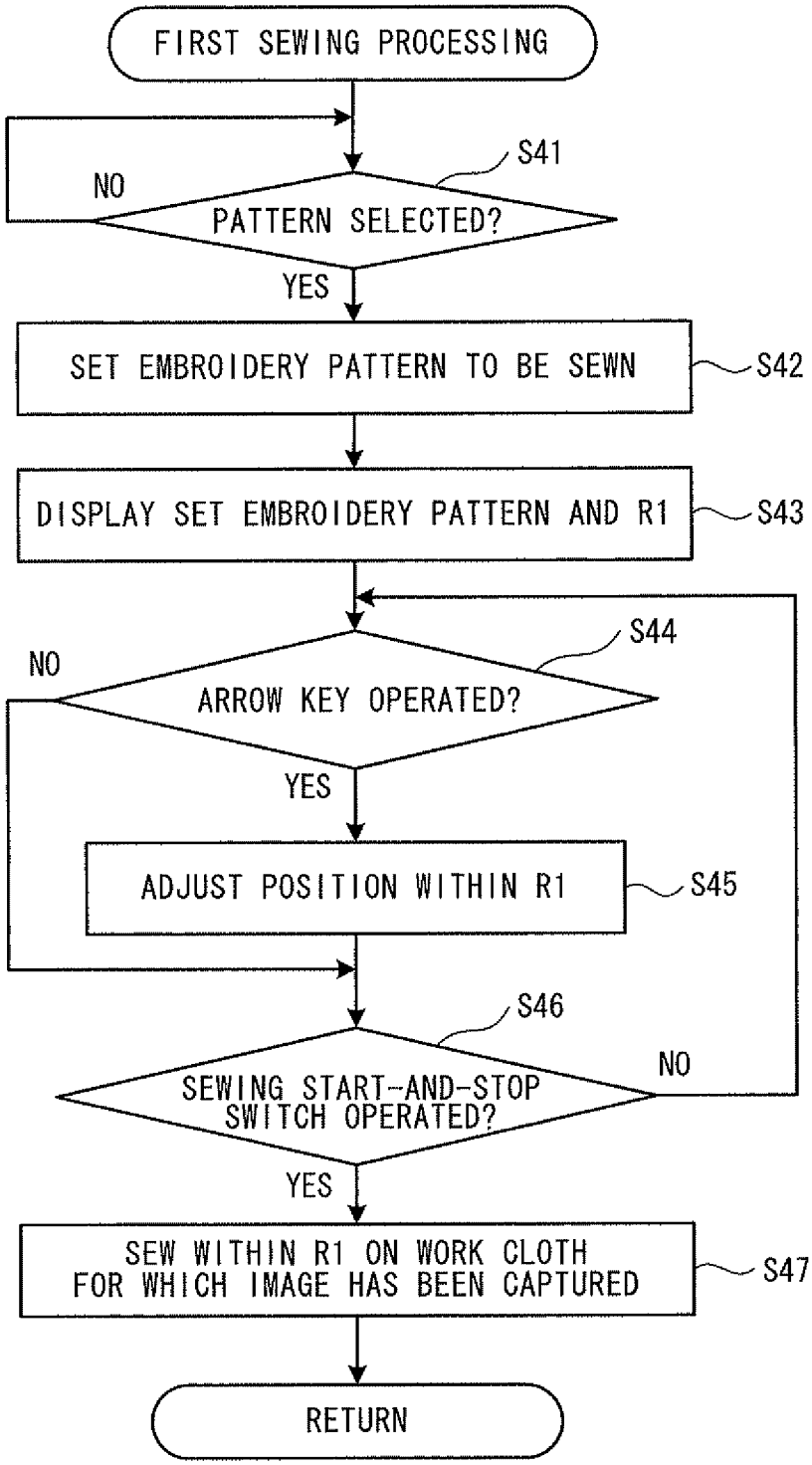
FIG. 10 is a flowchart of first sewing processing that is performed during the main processing.

As shown in FIG. 10, in the first sewing processing, a determination is made as to whether one of the embroidery patterns that are displayed on the liquid crystal display 10 has been selected by the user (Step S41). This determination is repeatedly made (NO at Step S41) until one of the embroidery patterns has been selected. When the user operates the touch panel 16 and selects one of the embroidery patterns (YES at Step S41), the selected embroidery pattern is set as the embroidery pattern that will actually be sewn on the work cloth 13 (Step S42). The embroidery pattern that has been set and the sewable area R1 are displayed on the liquid crystal display 10 such that their centers are aligned (Step S43). Arrow keys (not shown in the drawings) are also displayed in a portion of the liquid crystal display 10. A determination is made as to whether any one of the arrow keys has been operated through the touch panel 16 (Step S44). If one of the arrow keys has not been operated (NO at Step S44), the processing proceeds to a determination at Step S46. In a case where one of the arrow keys has been operated (YES at Step S44), the position of the embroidery pattern within the sewable area R1 that has been set is adjusted in accordance with the operated arrow key within the range in which the entire embroidery pattern fits within the sewable area R1 (Step S45). Next, a determination is made as to whether the sewing start-and-stop switch 21 (refer to FIGS. 1 and 2) has been operated (Step S46). IF the sewing start-and-stop switch 21 has not been operated (NO at Step S46), the processing returns to the determination at Step S44. If the sewing start-and-stop switch 21 has been operated (YES at Step S46), the embroidery pattern that the user has selected is sewn, in accordance with the embroidery data, within the sewable area R1 on the work cloth 13 for which the image has been captured, in the position that has been adjusted using the arrow keys (Step S47). The processing returns to the main processing, which is then terminated.

Figure 11:
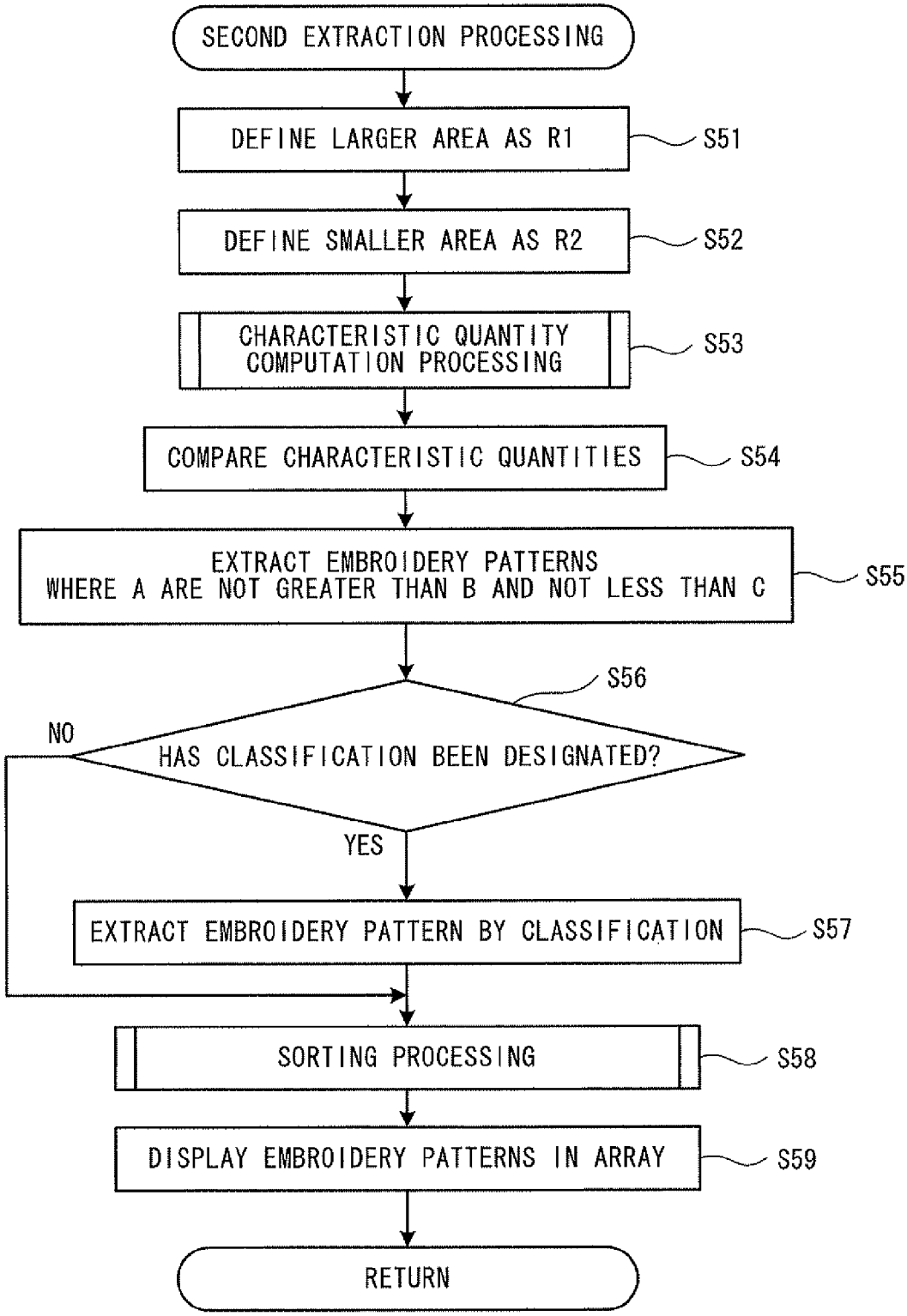
FIG. 11 is a flowchart of second extraction processing that is performed during the main processing.

The second extraction processing and the second sewing processing will be explained with reference to FIGS. 11 and 12. The second extraction processing that is shown in FIG. 11 is processing that extracts the embroidery patterns in a case where two allocated areas have been allocated on the work cloth 13. First, the larger of the two allocated areas that have been recognized is defined as the sewable area R1 (Step S51). The smaller area that has been recognized within the larger allocated area is defined as a minimum sewing area R2 for specifying the minimum size of the embroidery pattern that will be sewn (Step S52). The characteristic quantity computation processing is performed for each of the two defined areas R1 and R2 (Step S53). The processing is the same as the processing that is shown in FIG. 7. In the characteristic quantity computation processing, the width and the height of the largest rectangle that fits within the area are computed as the characteristic quantities.

The characteristic quantities A for each of the embroidery patterns that are stored in the data table (refer to FIG. 3) are compared to the corresponding characteristic quantities B for the sewable area R1 and to characteristic quantities C for the minimum sewing area R2 (Step S54). The embroidery patterns for which the characteristic quantities A are not greater than the corresponding characteristic quantities B for the sewable area R1 and not less than the corresponding characteristic quantities C for the minimum sewing area R2 are extracted from the embroidery patterns in the data table (Step S55). In other words, the embroidery patterns for which both the width and the height fit within the sewable area R1 and the width and the height are not less than the width and the height of the minimum sewing area R2 are extracted. A determination is made as to whether a classification has been designated for the embroidery pattern (Step S56). If a classification has not been designated (NO at Step S56), the processing proceeds to Step S58. If the classification has been designated (YES at Step S56), the embroidery patterns that belong to the designated classification are extracted from the embroidery patterns that have already been extracted (Step S57). Next, the sorting processing is performed that sorts the extracted embroidery patterns into a specified order (Step S58). The sorting processing is the same as the processing that is shown in FIG. 9, so an explanation will be omitted. The extracted embroidery patterns are displayed in an array on the liquid crystal display 10 in the order in which they have been sorted by the sorting processing (Step S59). The processing then returns to the main processing (refer to FIG. 5), and the second sewing processing is performed (Step S9).

Figure 12:
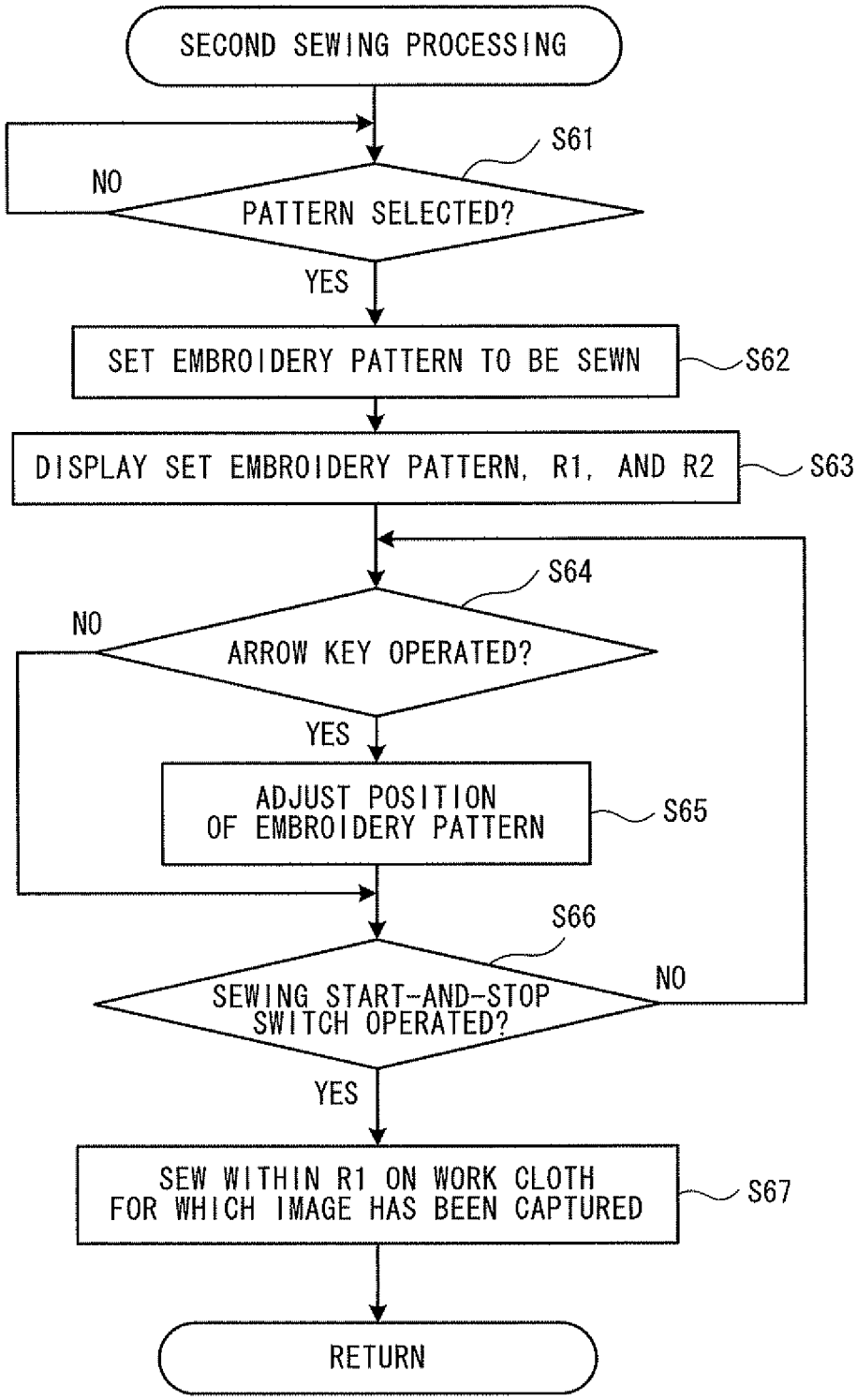
FIG. 12 is a flowchart of second sewing processing that is performed during the main processing.

As shown in FIG. 12, when the second sewing processing is started, a determination is made as to whether one of the embroidery patterns that are displayed on the liquid crystal display 10 has been selected by the user (Step S61). The determination at Step S61 is repeatedly made (NO at Step S61) until one of the embroidery patterns has been selected. When one of the embroidery patterns has been selected (YES at Step S61), the selected embroidery pattern is set as the embroidery pattern that will be sewn on the work cloth 13 (Step S62). The embroidery pattern that has been set is displayed on the liquid crystal display 10 such that it fits within the sewable area R1 and is superimposed on the minimum sewing area R2 (Step S63). A determination is made as to whether one of the arrow keys has been operated through the touch panel 16 (Step S64). If one of the arrow keys has not been operated (NO at Step S64), the processing proceeds to a determination at Step S66. If one of the arrow keys has been operated (YES at Step S64), the position of the embroidery pattern within the sewable area R1 is adjusted in accordance with the operation of the arrow key within the range in which the embroidery pattern is superimposed on the minimum sewing area R2 (Step S65). Next, a determination is made as to whether the sewing start-and-stop switch 21 has been operated (Step S66). If the sewing start-and-stop switch 21 has not been operated (NO at Step S66), the processing returns to the determination at Step S64. If the sewing start-and-stop switch 21 has been operated (YES at Step S66), the embroidery pattern that the user has selected is sewn in the position that has been set within the sewable area R1 (Step S67). The processing returns to the main processing, which is then terminated.

Specific examples of the extracting of the embroidery pattern by the first extraction processing and the second extraction processing will be explained. First, an example will be explained of a case in which the user has allocated one allocated area and has not designated a classification. When the user has allocated the one allocated area and the main processing (refer to FIG. 5) is started, in the main processing, the one allocated area is recognized (NO at Step S5), and the first extraction processing is performed (Step S6). In the first extraction processing (refer to FIG. 6), the recognized allocated area is defined as the sewable area R1 (Step S11), and the characteristic quantities for the defined sewable area R1 are computed (Step S12). Assume that the computed characteristic quantities are a width of 6.2 centimeters and a height of 6.0 centimeters. In this case, the embroidery patterns for which the width is not greater than 6.2 centimeters and the height is not greater than 6.0 centimeters are extracted from the embroidery patterns in the data table (refer to FIG. 3) (Step S14). The extracted embroidery patterns are sorted in descending order by their surface areas (Step S17) and are displayed in an array on the liquid crystal display 10 (Step S18). The results that are displayed in this case are shown in FIG. 13. The embroidery patterns that are shown in FIG. 13 can be sewn within the sewable area R1 without being reduced, having their shapes changed, or the like.

Next, an example will be explained of a case in which the user has started the main processing after allocating two allocated areas and designating "animal" as the classification. In the main processing (refer to FIG. 5), the two allocated areas are recognized (YES at Step S5), and the second extraction processing is performed (Step S8). In the second extraction processing (refer to FIG. 11), the larger of the two recognized allocated areas is defined as the sewable area R1 (Step S51). The smaller area within the sewable area R1 is defined as the minimum sewing area R2 (Step S52). The characteristic quantities are computed for the two areas R1 and R2 (Step S53). Assume that the computed characteristic quantities for the sewable area R1 are a width of 6.2 centimeters and a height of 6.0 centimeters, the same as in the previously described example. Assume that the computed characteristic quantities for the minimum sewing area R2 are a width of 0.8 centimeters and a height of 2.0 centimeters. In this case, the embroidery patterns for which the width is not less than 0.8 centimeters and not greater than 6.2 centimeters and the height is not less than 2.0 centimeters and not greater than 6.0 centimeters are extracted (Step S55). Furthermore, because the classification "animal" has been designated (YES at Step S56), the embroidery patterns that belong to the classification "animal" are extracted from the previously extracted embroidery patterns (Step S57). The extracted embroidery patterns are sorted in descending order by their surface areas (Step S58) and are displayed on the liquid crystal display 10 (Step S59). The results that are displayed in this case are shown in FIG. 14. As shown in FIG. 14, the embroidery patterns that are smaller than the minimum sewing area R2 are not extracted by the second extraction processing. This makes it possible for the user to recognize easily and accurately which of the embroidery patterns fits within the sewable area R1 and has the desired size. By designating the desired classification, the user can cause only the embroidery patterns that belong to the designated classification to be displayed.

As explained previously, the sewing machine 1 according to the present embodiment defines the sewable area R1, which is the area within which the embroidery pattern can be sewn. the sewing machine 1 can extract the embroidery patterns that fit into the sewable area R1 and notify the user. The user can therefore easily and accurately recognize what embroidery patterns can be sewn in the sewable area R1 without being processed. If the user allocates two allocated areas, the sewing machine 1 defines the smaller of the allocated areas as the minimum sewing area R2. The sewing machine 1 does not extract the embroidery patterns for which the characteristic quantities are smaller than those for the minimum sewing area R2. The user can therefore easily cause the sewing machine 1 to extract the embroidery patterns of the desired size. The user can also adjust the position of the embroidery pattern within the sewable area R1 and within the range in which the embroidery pattern is superimposed on the minimum sewing area R2. In other words, fine adjustment of the position of the embroidery pattern can be performed easily by using the position of the minimum sewing area R2 as a reference.

The sewing machine 1 can sort the extracted embroidery patterns in a specified order and display them on the liquid crystal display 10. This makes it possible for the user to recognize the extracted embroidery patterns accurately in accordance with the specified order. The sewing machine 1 computes, as the characteristic quantities for the sewable area R1, the width and the height of the largest rectangle that fits within the sewable area R1. This makes it possible to easily extract the embroidery patterns that fit within the sewable area R1, regardless of the shape of the sewable area R1.

Based on the image data of the work cloth 13 that have been captured by the image sensor 50, the sewing machine 1 recognizes the allocated areas that have been allocated on the work cloth 13. The sewing machine 1 can define the recognized allocated areas as the sewable area R1 and the minimum sewing area R2. This makes it possible for the user to cause the sewing machine 1 to define the sewable area R1 and the minimum sewing area R2 of the desired sizes and in the desired positions on the work cloth 13, by allocating the allocated areas on the work cloth 13 and causing the image sensor 50 to capture an image of the work cloth 13. The sewing machine 1 can accurately sew the embroidery pattern that the user has selected in an appropriate position within the sewable area R1 on the work cloth 13 for which the image sensor 50 has captured the image. This makes it possible for the user to cause the desired embroidery pattern that fits within the sewable area R1 to be sewn in an appropriate position, simply by selecting the desired embroidery pattern from among the embroidery patterns that have been extracted and displayed. There is also no need for the user to perform cumbersome processing, such as resetting the position on the work cloth 13 after the embroidery pattern has been selected, and the like.

The present disclosure is not limited to the embodiment that is described above, and various types of modifications can obviously be made. Modified examples of the embodiment that is described above will hereinafter be explained.

A first modified example of the embodiment that is described above will be explained with reference to FIG. 15. The sewing machine 1 according to the first modified example differs from the sewing machine 1 according to the embodiment that is described above only in the method for defining the sewable area R1 and the minimum sewing area R2. Accordingly, explanations will be one of omitted and simplified for any processing that is the same as the pressing in the embodiment that is described above. In the embodiment that is described above, the user allocates the allocated areas on the work cloth 13 in advance and then starts the main processing. In contrast, in the first modified example, the user can operate the touch panel 16 in order to define the sewable area R1 and the minimum sewing area R2 on the work cloth 13 that is displayed on the liquid crystal display 10. The user uses the embroidery frame 12 to secure the work cloth 13 in the sewing machine 1, then starts the main processing.

Figure 15:
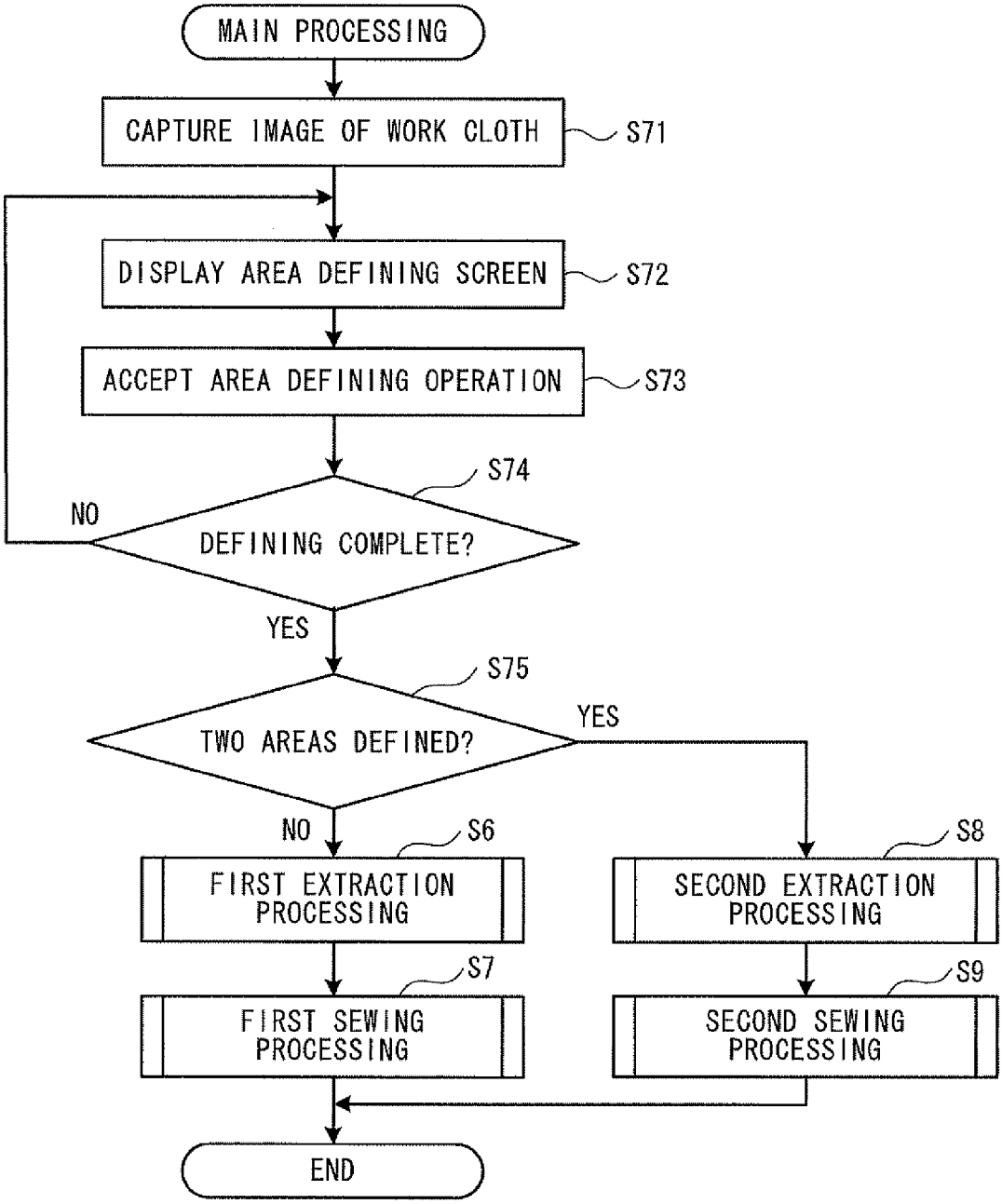
FIG. 15 is a flowchart of main processing that is performed by a sewing machine according to a first modified example.

As shown in FIG. 15, when the main processing is started, an image of the work cloth 13 is captured by the image sensor 50 (Step S71). An area defining screen is displayed on the liquid crystal display 10 (Step S72). The captured image of the work cloth 13 is displayed on the area defining screen. Next, an area defining operation by the user is accepted (Step S73). The user defines a closed area by using a finger, a touch pen (not shown in the drawings), or the like to trace the desired position on the work cloth 13 that is being displayed on the liquid crystal display 10. If the defining of the areas by the user has not been completed (NO at Step S74), the processing returns to Step S72, and the defined areas are displayed on the liquid crystal display 10.

When a command is input by the user that indicates that the defining of the areas has been completed (YES at Step S74), a determination is made as to whether two areas have been defined (Step S75). If only one area has been defined (NO at Step S75), the one area that the user has defined is defined as the sewable area R1, and the subsequent processing is performed (Steps S6, S7). If two areas have been defined (YES at Step S75), the larger area is defined as the sewable area R1, the smaller area is defined as the minimum sewing area R2, and the subsequent processing is performed (Steps S8, S9).

As explained above, according to the sewing machine 1 according to the first modified example, the user is able to define the sewable area R1 and the minimum sewing area R2 of the appropriate sizes and in the appropriate positions on the work cloth 13 while watching the work cloth 13 that is displayed on the liquid crystal display 10. There is no need for the user to perform a task such as redrawing the areas on the work cloth 13 or the like.

A second modified example of the embodiment that is described above will be explained. The sewing machine 1 according to the second modified example recognizes at least one color of the portion of the work cloth 13 that is within the sewable area R1. The sewing machine 1 sorts the embroidery patterns that fit into the sewable area R1 in descending order according to the number of threads that the embroidery patterns use that are similar in color to the at least one color of the work cloth 13 that the sewing machine 1 has recognized. The sorting processing according to the second modified example (refer to FIG. 9) performs processing that recognizes the at least one color of the portion of the work cloth 13 that is within the sewable area R1, instead of the processing that computes the surface area (Step S32). Instead of performing the processing at Step S33, the sewing machine 1 refers to the thread color lists that have been acquired from the data table (refer to FIG. 3) and sorts the embroidery patterns in descending order according to the number of threads that are used that are similar in color to the at least one color of the work cloth 13 that has been recognized. Thus the order in which the extracted embroidery patterns are sorted is not limited to being the descending order according to the surface area of the embroidery pattern. A method that sorts the embroidery patterns numerically according to the control ID or the like can also be used.

Other modifications can also be made to the embodiment that is described above. In the embodiment that is described above, the processing that extracts the embroidery patterns that fit within the sewable area R1 and notifies the user is performed by the sewing machine 1. However, it is obvious that the processing may also be performed by another device, such as a personal computer or the like. In the embodiment that is described above, the program for performing the main processing is stored in the ROM 62. However, it is obvious that the program may also be stored in another storage medium, such as the EEPROM 64, a CD-ROM that is not shown in the drawings, or the like.

The sewing machine 1 according to the embodiment that is described above performs the extracting of the embroidery patterns using the widths and the heights of the areas as the characteristic quantities. However, any quantity that at least makes it possible to specify the size of an area can be used as the characteristic quantity. For example, the sewing machine 1 may also extract the embroidery patterns by identifying the largest ellipse that fits within the sewable area R1, then comparing the major axis and the minor axis of the ellipse to the major axis and the minor axis of an ellipse that surrounds the entire embroidery pattern. Together with the quantity that specifies the size of the area, the sewing machine 1 may also use another parameter, such as a degree of circularity or the like, as a characteristic quantity.

In the embodiment that is described above, the method for computing the characteristic quantities for the minimum sewing area R2 is the same as the method for computing the characteristic quantities for the sewable area R1. That is, the width and the height of the largest rectangle that fits within the minimum sewing area R2 are computed as the characteristic quantities. However, it is obvious that the method for computing the characteristic quantities for the minimum sewing area R2 can be modified. For example, the sewing machine 1 may also compute the width and the height of the smallest rectangle within which the minimum sewing area R2 fits as the characteristic quantities. In that case, only the embroidery patterns of a size that can cover the entire minimum sewing area R2 will be extracted.

In the embodiment that is described above, the sewing machine 1 can further narrow down the embroidery patterns that are extracted by extracting, from among the embroidery patterns that fit within the sewable area R1, the embroidery patterns that belong to the classification that the user has designated. However, the method for narrowing down the embroidery patterns that are extracted can be modified. For example, the sewing machine 1 can narrow down the extracted embroidery patterns according to the number of the thread colors that are used in the sewing, the ratios of the colors, a history of the embroidery patterns that the user has selected in the past, or the like.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery data processing device that processes embroidery data for sewing an embroidery pattern on a work cloth in a sewing machine that is capable of performing embroidery sewing, the embroidery data processing device comprising:

an area defining portion that defines a sewable area that is an area on the work cloth where the embroidery pattern can be sewn;

a computation portion that computes a first characteristic quantity that is a quantity that specifies a size of the sewable area defined by the area defining portion;

a comparison portion that compares the first characteristic quantity computed by the computation portion to at least one characteristic quantity for at least one embroidery pattern that can be sewn based on the embroidery data, the at least one characteristic quantity being stored in a storage portion that stores data and specifying a size of the at least one embroidery pattern;

an extraction portion that, in a case where a comparison by the comparison portion determines that at least one sewable pattern of the at least one embroidery pattern exists, extracts the at least one sewable pattern, the at least one characteristic quantity of the at least one sewable pattern being not greater than the first characteristic quantity; and a notification portion that notifies a user about the at least one sewable pattern extracted by the extraction portion.

2. The embroidery data processing device according to claim 1, further comprising:

an order setting portion that sets an order in which the at least one sewable pattern extracted by the extraction portion will be arranged, wherein the notification portion displays the at least one sewable pattern extracted by the extraction portion in the order set by the order setting portion.

3. The embroidery data processing device according to claim 1, wherein the area defining portion also defines a minimum sewing area that is an area within the sewable area and is an area that specifies a minimum size of an embroidery pattern that will be sewn, the computation portion computes the first characteristic quantity and a second characteristic quantity that is a quantity that specifies a size of the minimum sewing area, the comparison portion compares the first characteristic quantity and the second characteristic quantity computed by the computation portion to the at least one characteristic quantity for the at least one embroidery pattern stored in the storage portion, and the extraction portion, based on the comparison by the comparison portion, extracts, as the at least one sewable pattern, at least one embroidery pattern that is not greater than the sewable area and for which the at least one characteristic quantity is not less than the second characteristic quantity for the minimum sewing area.

4. The embroidery data processing device according to claim 3, further comprising:

an adjustment portion that adjusts a sewing position of an embroidery pattern selected from among the at least one sewable pattern, within a range in which the selected embroidery pattern is not greater than the sewable area and is superimposed on the minimum sewing area.

5. The embroidery data processing device according to claim 1, wherein the computation portion computes, as the first characteristic quantity, at least a width and a height of a largest rectangle that is not greater than the sewable area defined by the area defining portion.

6. The embroidery data processing device according to claim 1, wherein the area defining portion defines the sewable area on the work cloth displayed by a display portion that displays an image, in accordance with an operation of an operation portion operated by the user.

7. The embroidery data processing device according to claim 1, wherein the area defining portion, based on image data for the work cloth captured by an image capture portion that captures an image of the work cloth, recognizes a closed area that is disposed on the work cloth and defines the recognized closed area as the sewable area.

8. A non-transitory computer-readable medium storing an embroidery data processing program for processing embroidery data for sewing an embroidery pattern on a work cloth in a sewing machine that is capable of performing embroidery sewing, the program comprising instructions that cause a computer to perform the steps of:

defining a sewable area that is an area on the work cloth where the embroidery pattern can be sewn;

computing a first characteristic quantity that is a quantity that specifies a size of the sewable area that has been defined;

comparing the first characteristic quantity that has been computed to at least one characteristic quantity for at least one embroidery pattern that can be sewn based on the embroidery data, the at least one characteristic quantity being stored in a storage portion that stores data and specifying a size of the at least one embroidery pattern;

extracting, in a case where the comparison determines that at least one sewable pattern of the at least one embroidery pattern exists, the at least one sewable pattern, the at least one characteristic quantity of the at least one sewable pattern being not greater than the first characteristic quantity; and notifying a user about the at least one sewable pattern that has been extracted.

9. The non-transitory computer-readable medium according to claim 8, wherein the embroidery data processing program further comprises instructions to cause the computer to perform the step of:

setting an order in which the at least one sewable pattern that has been extracted will be arranged, wherein the at least one sewable pattern that has been extracted is displayed in the order that has been set.

10. The non-transitory computer-readable medium according to claim 8, wherein a minimum sewing area is also defined when the sewable area is defined, the minimum sewing area being an area within the sewable area and being an area that specifies a minimum size of an embroidery pattern that will be sewn, a second characteristic quantity is also computed when the first characteristic quantity is computed, the second characteristic quantity being a quantity that specifies a size of the minimum sewing area, the first characteristic quantity and the second characteristic quantity that have been computed are compared to the at least one characteristic quantity for the at least one embroidery pattern stored in the storage portion, and the at least one embroidery pattern that is not greater than the sewable area and for which the at least one characteristic quantity is not less than the second characteristic quantity for the minimum sewing area is extracted based on the comparison.

11. The non-transitory computer-readable medium according to claim 10, wherein the embroidery data processing program further comprises instructions to cause the computer to perform the step of:

adjusting a sewing position of an embroidery pattern selected from among the at least one sewable pattern, within a range in which the selected embroidery pattern is not greater than the sewable area and is superimposed on the minimum sewing area.

12. The non-transitory computer-readable medium according to claim 8, wherein the first characteristic quantity includes at least a width and a height of a largest rectangle that is not greater than the sewable area.

13. The non-transitory computer-readable medium according to claim 8, wherein the sewable area is defined on the work cloth displayed by a display portion that displays an image, in accordance with an operation of an operation portion operated by the user.

14. The non-transitory computer-readable medium according to claim 8, wherein a closed area that is disposed on the work cloth is recognized based on image data for the work cloth captured by an image capture portion that captures an image of the work cloth, and the recognized closed area is defined as the sewable area.

15. A sewing machine that is capable of processing embroidery data for sewing an embroidery pattern on a work cloth and performing embroidery sewing, comprising:

an area defining portion that defines a sewable area that is an area on the work cloth where the embroidery pattern can be sewn;

a computation portion that computes a first characteristic quantity that is a quantity that specifies a size of the sewable area defined by the area defining portion;

a comparison portion that compares the first characteristic quantity computed by the computation portion to at least one characteristic quantity for at least one embroidery pattern that can be sewn based on the embroidery data, the at least one characteristic quantity being stored in a storage portion that stores data and specifying a size of the at least one embroidery pattern;

an extraction portion that, in a case where a comparison by the comparison portion determines that at least one sewable pattern of the at least one embroidery pattern exists, extracts the at least one sewable pattern, the at least one characteristic quantity of the at least one sewable pattern being not greater than the first characteristic quantity; and a notification portion that notifies a user about the at least one sewable pattern extracted by the extraction portion;

an image capture portion that captures an image of the work cloth;

a pattern setting portion that takes one of the at least one sewable pattern which the notification portion has notified the user about, and that the user has selected, and sets the selected sewable pattern as the embroidery pattern that will be sewn on the work cloth; and a sewing portion that sews, within the sewable area on the work cloth of which the image has been captured by the image capture portion, the embroidery pattern set by the pattern setting portion.

16. The sewing machine according to claim 15, further comprising:

an order setting portion that sets an order in which the at least one sewable pattern extracted by the extraction portion will be arranged, wherein the notification portion displays the at least one sewable pattern extracted by the extraction portion in the order set by the order setting portion.

17. The sewing machine according to claim 15, wherein the area defining portion also defines a minimum sewing area that is an area within the sewable area and is an area that specifies a minimum size of an embroidery pattern that will be sewn, the computation portion computes the first characteristic quantity and a second characteristic quantity that is a quantity that specifies a size of the minimum sewing area, the comparison portion compares the first characteristic quantity and the second characteristic quantity computed by the computation portion to the at least one characteristic quantity for the at least one embroidery pattern stored in the storage portion, and the extraction portion, based on the comparison by the comparison portion, extracts, as the at least one sewable pattern, at least one embroidery pattern that is not greater than the sewable area and for which the at least one characteristic quantity is not less than the second characteristic quantity for the minimum sewing area.

18. The sewing machine according to claim 17, further comprising:

an adjustment portion that adjusts a sewing position of an embroidery pattern selected from among the at least one sewable pattern, within a range in which the selected embroidery pattern is not greater than the sewable area and is superimposed on the minimum sewing area.

19. The sewing machine according to claim 15, wherein the computation portion computes, as the first characteristic quantity, at least a width and a height of a largest rectangle that is not greater than the sewable area defined by the area defining portion.

20. The sewing machine according to claim 15, wherein the area defining portion, based on image data for the work cloth captured by the image capture portion, recognizes a closed area that is disposed on the work cloth and defines the recognized closed area as the sewable area.

* * * * *